US010807690B1

(12) United States Patent
Allen

(10) Patent No.: US 10,807,690 B1
(45) Date of Patent: Oct. 20, 2020

(54) MECHANICAL OAR SYSTEM

(71) Applicant: Anthony Allen, Oakland, CA (US)

(72) Inventor: Anthony Allen, Oakland, CA (US)

( * ) Notice: Subject to any disclaimer, the term of this patent is extended or adjusted under 35 U.S.C. 154(b) by 237 days.

(21) Appl. No.: 16/043,373

(22) Filed: Jul. 24, 2018

(51) Int. Cl.
*B63H 1/32* (2006.01)
*B63H 5/00* (2006.01)

(52) U.S. Cl.
CPC ..... *B63H 1/32* (2013.01); *B63H 5/00* (2013.01)

(58) Field of Classification Search
CPC ... B63H 1/00; B63H 1/30; B63H 1/32; B63H 5/00; B63H 2005/005
USPC ..... 440/21, 25–32, 101–104
See application file for complete search history.

(56) References Cited

U.S. PATENT DOCUMENTS 2,682,249 A 6/1954 Brady
2,873,713 A 2/1959 Baastrup
3,007,434 A 11/1961 Dewey
D217,939 S 6/1970 Nichols
3,756,187 A * 9/1973 Livaudais ..... B63H 1/32 440/20
3,967,574 A 7/1976 Golden
4,157,597 A * 6/1979 Trebnick ..... B63B 34/56 441/76
4,261,069 A * 4/1981 Schaumann ..... B63B 34/56 441/77
4,459,118 A * 7/1984 Schaumann ..... B63B 34/56 441/76
4,541,809 A * 9/1985 Schaumann ..... B63B 34/56 441/76
4,698,039 A * 10/1987 Watson ..... B63B 32/20 441/77
4,795,381 A * 1/1989 Willems ..... B63H 16/14 440/26
4,960,396 A * 10/1990 Stolzer ..... B63H 16/12 114/153
5,194,023 A 3/1993 Stone
5,413,066 A * 5/1995 Spencer, Jr. ..... B63B 7/082 114/354
5,669,793 A * 9/1997 Walton ..... B63H 1/32 440/19
6,855,024 B2 * 2/2005 Rothschild ..... B63H 16/08 441/77
7,048,599 B1 * 5/2006 Garwood ..... B63H 16/18 440/21
7,121,910 B2 * 10/2006 Rosen ..... B63H 16/08 441/76

(Continued)

FOREIGN PATENT DOCUMENTS

DE 102011104755 12/2012

*Primary Examiner* — Daniel V Venne

(57) ABSTRACT

The mechanical oar system is a manually powered propulsion system for a vessel. The vessel is a personal watercraft. The mechanical oar system is configured for use with a person. The mechanical oar system is powered by the person. The mechanical oar system comprises a plurality of drive mechanisms and a vessel. The plurality of drive mechanisms are integrated into the vessel. Each of the plurality of drive mechanisms is manually powered. Each of the plurality of drive mechanisms comprises a mechanism that moves an oar structure (referred to in this disclosure as a blade). The oar structure propels the vessel in a desired direction. Each of the plurality of drive mechanisms is oriented relative to the vessel such that the direction of the propulsive forces can be adjusted by the person.

17 Claims, 7 Drawing Sheets

(56) References Cited

U.S. PATENT DOCUMENTS

| | | | | |
|---|---|---|---|---|
| 7,300,324 | B2 * | 11/2007 | Garwood | B63H 16/12<br>440/102 |
| 7,785,161 | B2 * | 8/2010 | Wilkinson | B63H 16/12<br>440/21 |
| 9,359,056 | B2 | 6/2016 | Lyons | |
| 10,124,869 | B1 * | 11/2018 | Bailey | B63H 16/08 |

* cited by examiner

MECHANICAL OAR SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including propulsion of waterborne vessels, more specifically, an apparatus for converting muscle power into propulsion through bow facing rowing.

SUMMARY OF INVENTION

The mechanical oar system is a manually powered propulsion system for a vessel. The vessel is a personal watercraft. The mechanical oar system is configured for use with a person. The mechanical oar system is powered by the person. The mechanical oar system comprises a plurality of drive mechanisms and a vessel. The plurality of drive mechanisms are integrated into the vessel. Each of the plurality of drive mechanisms is manually powered. Each of the plurality of drive mechanisms comprises a mechanism that moves an oar structure (referred to in this disclosure as a blade). The oar structure propels the vessel in a desired direction. Each of the plurality of drive mechanisms is oriented relative to the vessel such that the direction of the propulsive forces can be adjusted by the person.

These together with additional objects, features and advantages of the mechanical oar system will be readily apparent to those of ordinary skill in the art upon reading the following detailed description of the presently preferred, but nonetheless illustrative, embodiments when taken in conjunction with the accompanying drawings.

In this respect, before explaining the current embodiments of the mechanical oar system in detail, it is to be understood that the mechanical oar system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mechanical oar system.

It is therefore important that the claims be regarded as including such equivalent construction insofar as they do not depart from the spirit and scope of the mechanical oar system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
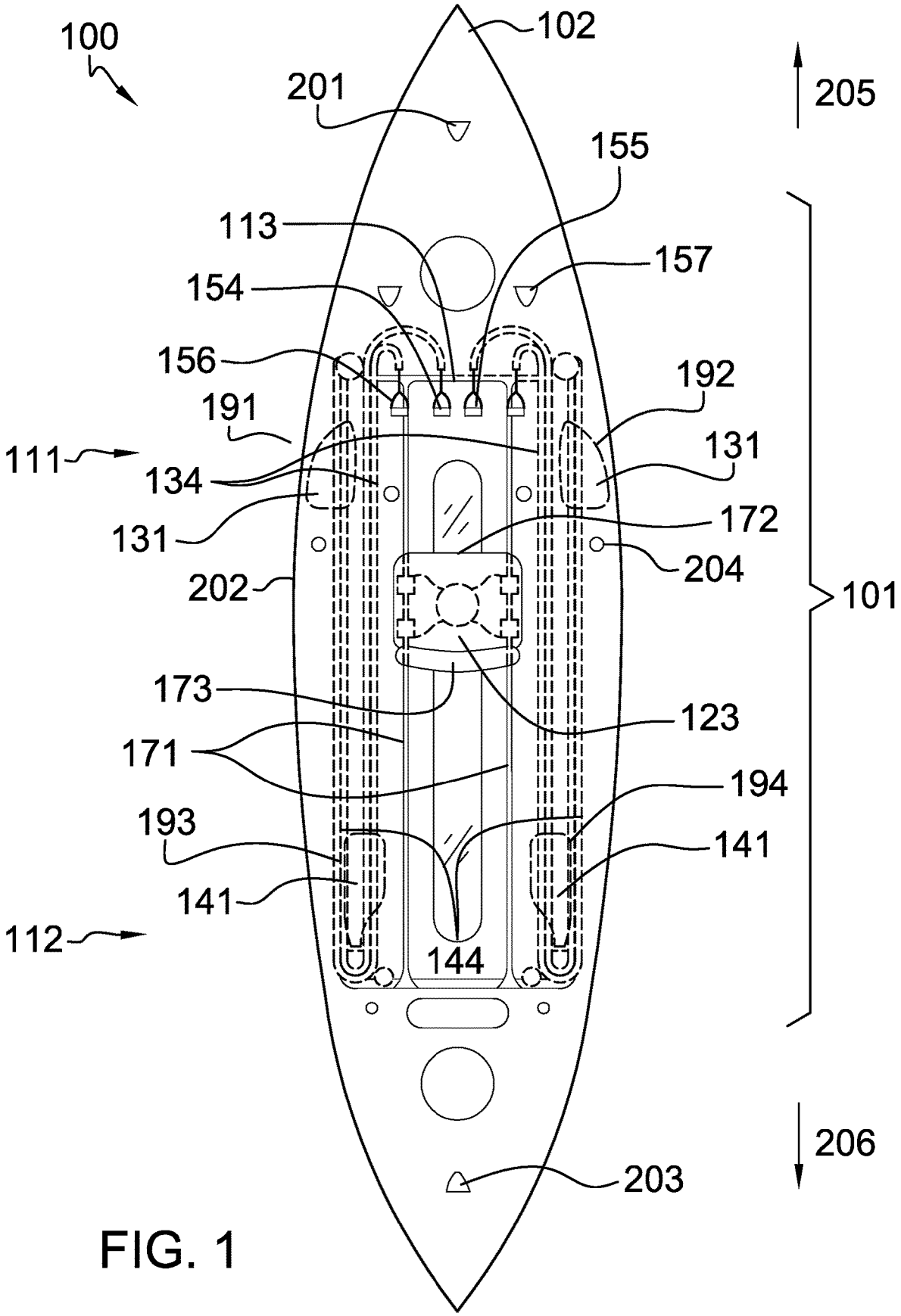
FIG. 1 is a top view of an embodiment of the disclosure.
Figure 2:
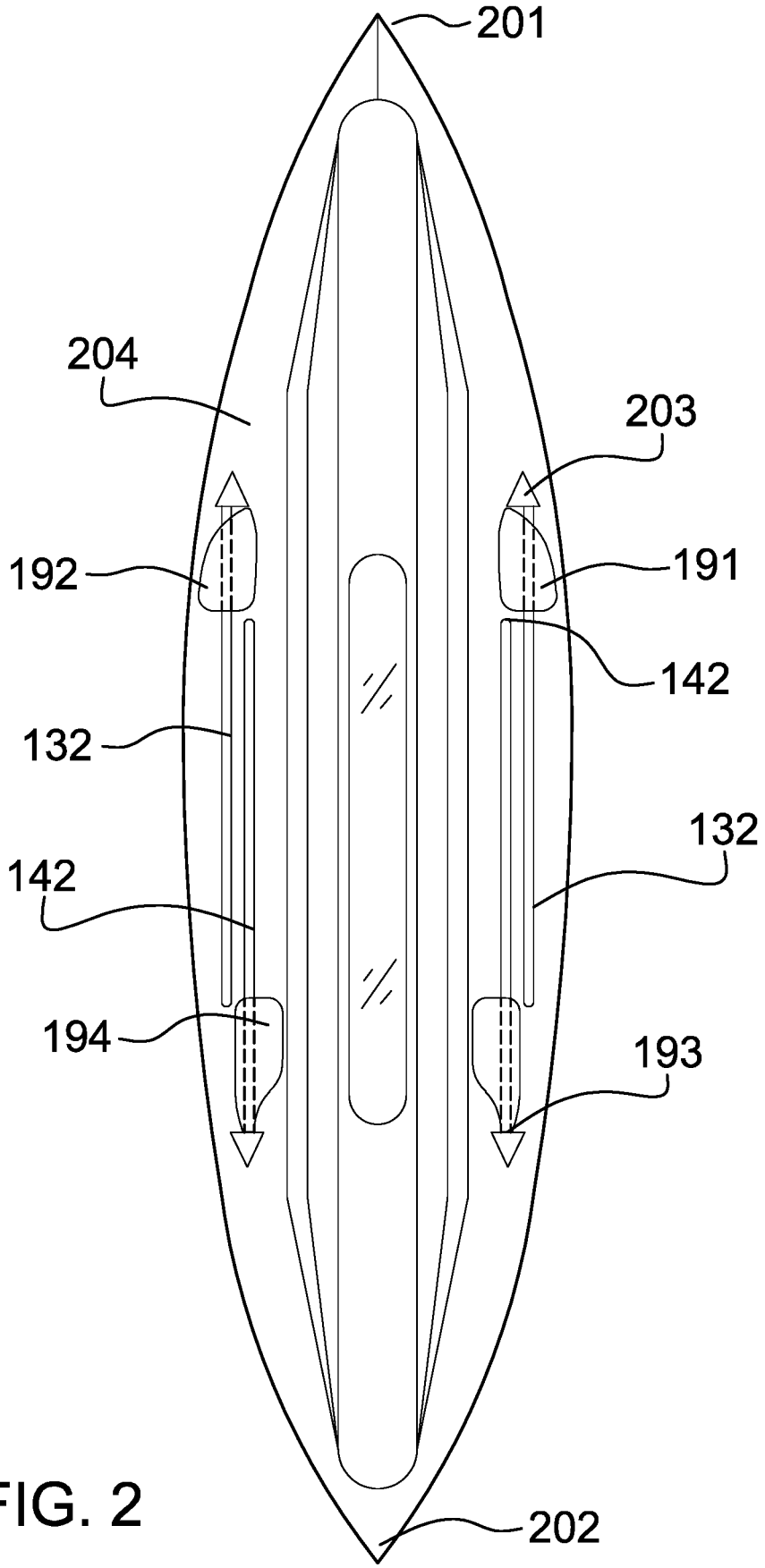
FIG. 2 is a bottom view of an embodiment of the disclosure.
Figure 3:
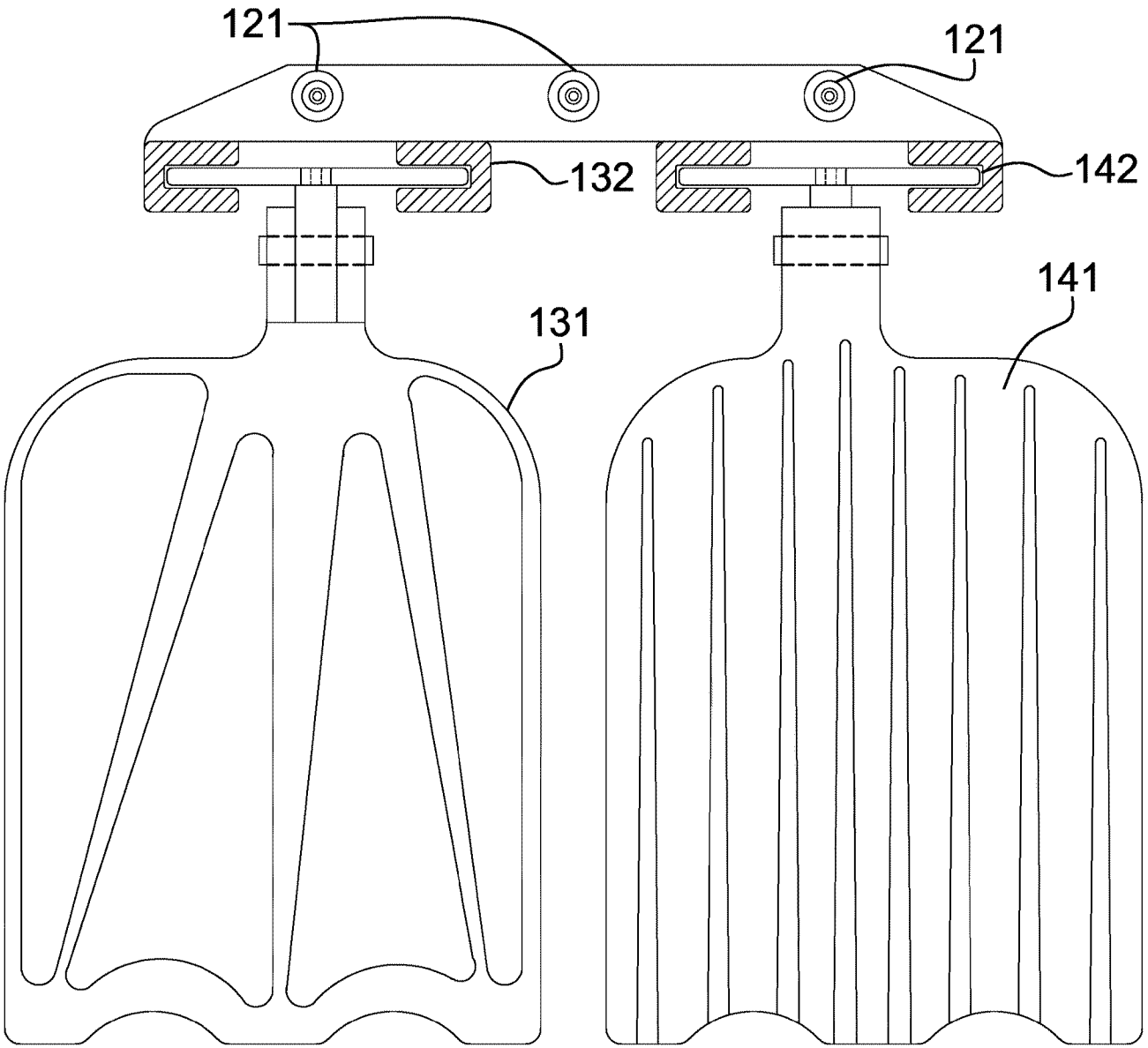
FIG. 3 is a detail view of an embodiment of the disclosure.
Figure 4:
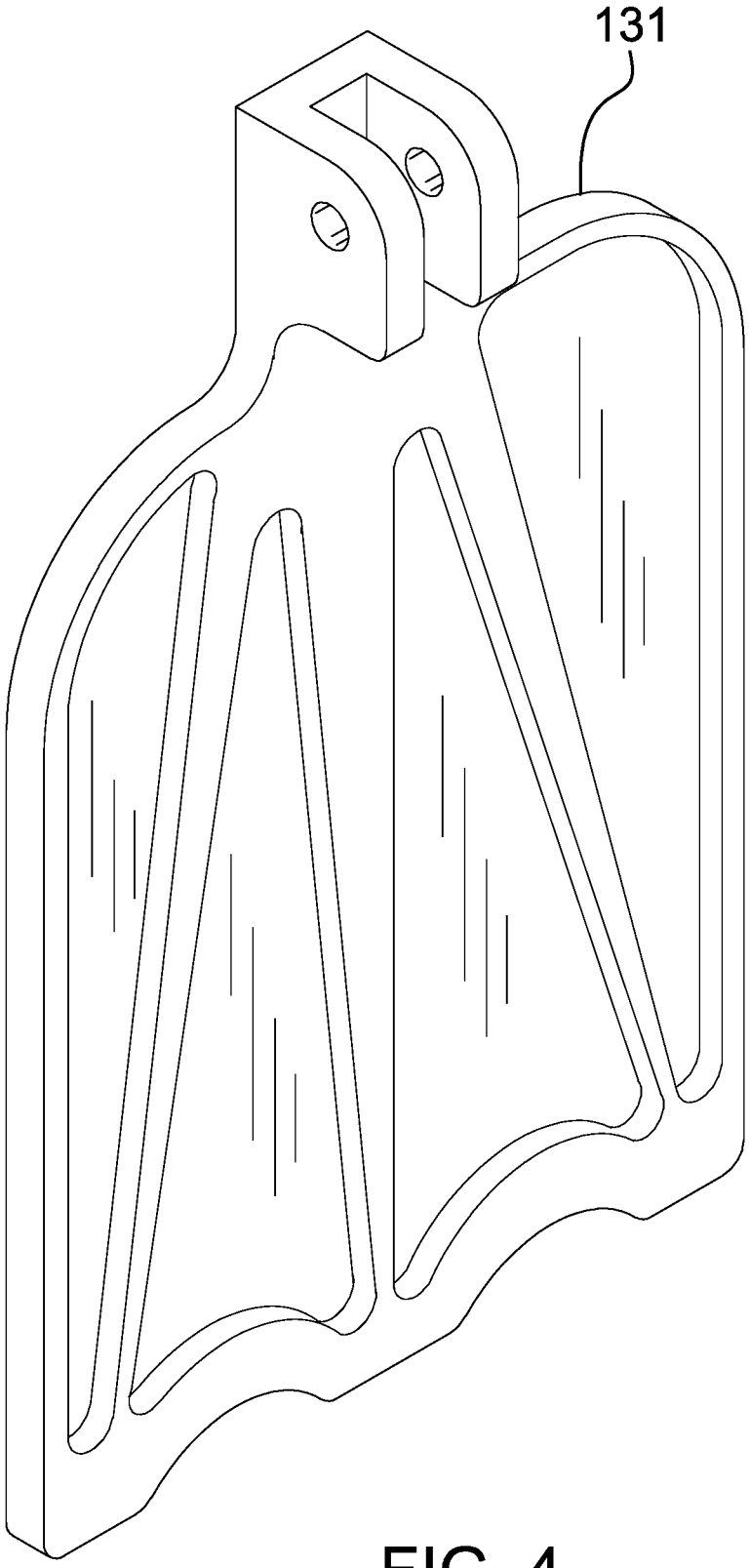
FIG. 4 is a detail view of an embodiment of the disclosure.
Figure 5:
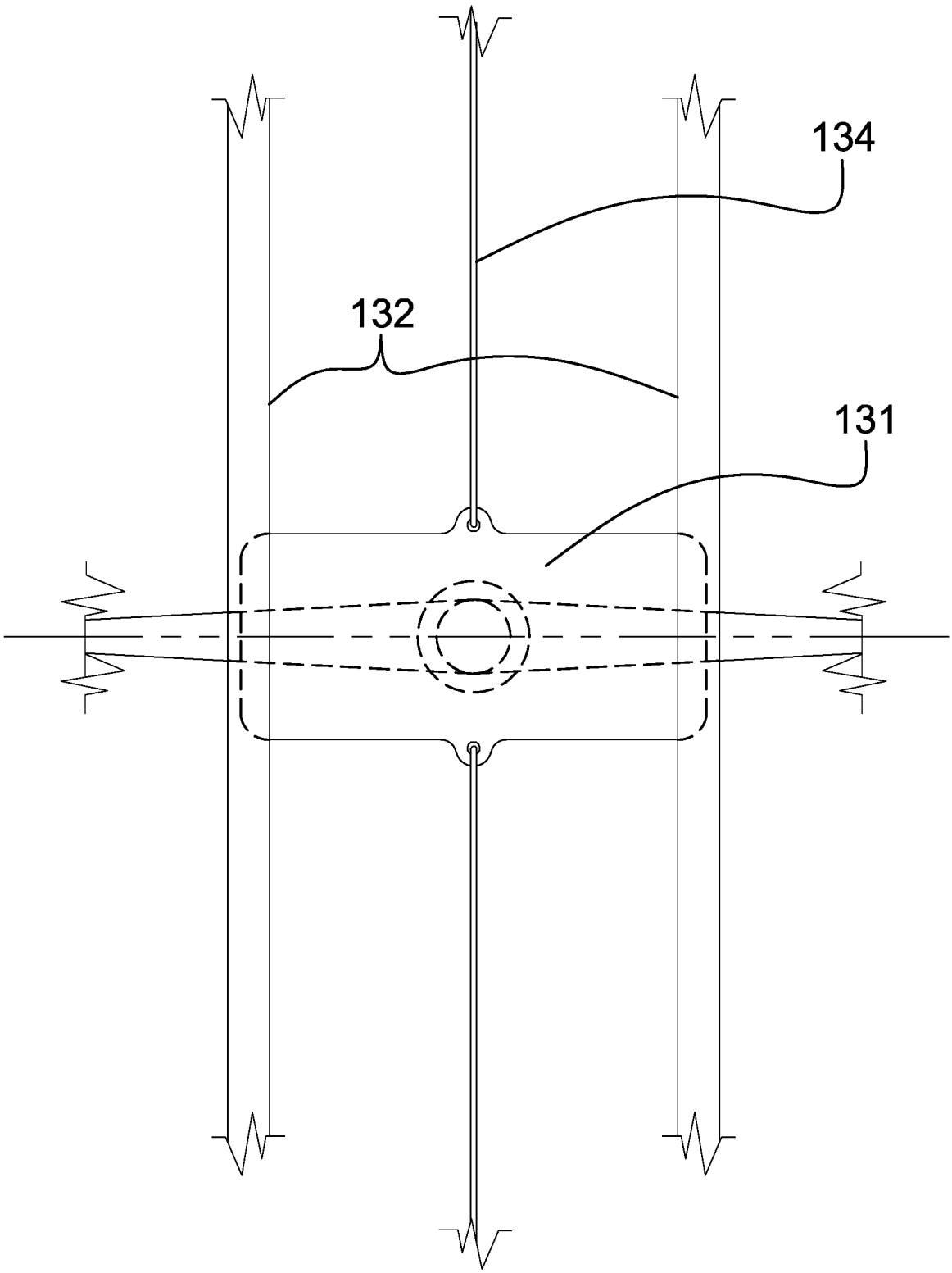
FIG. 5 is a detail view of an embodiment of the disclosure.
Figure 6:
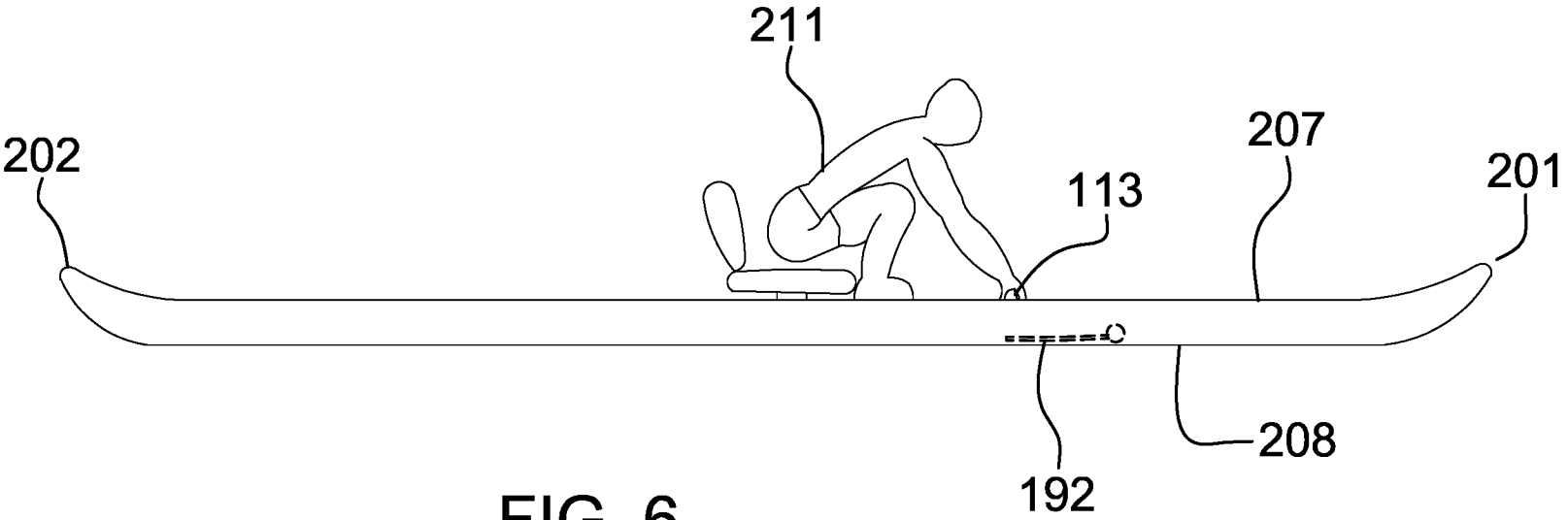
FIG. 6 is a side view of an embodiment of the disclosure.
Figure 7:
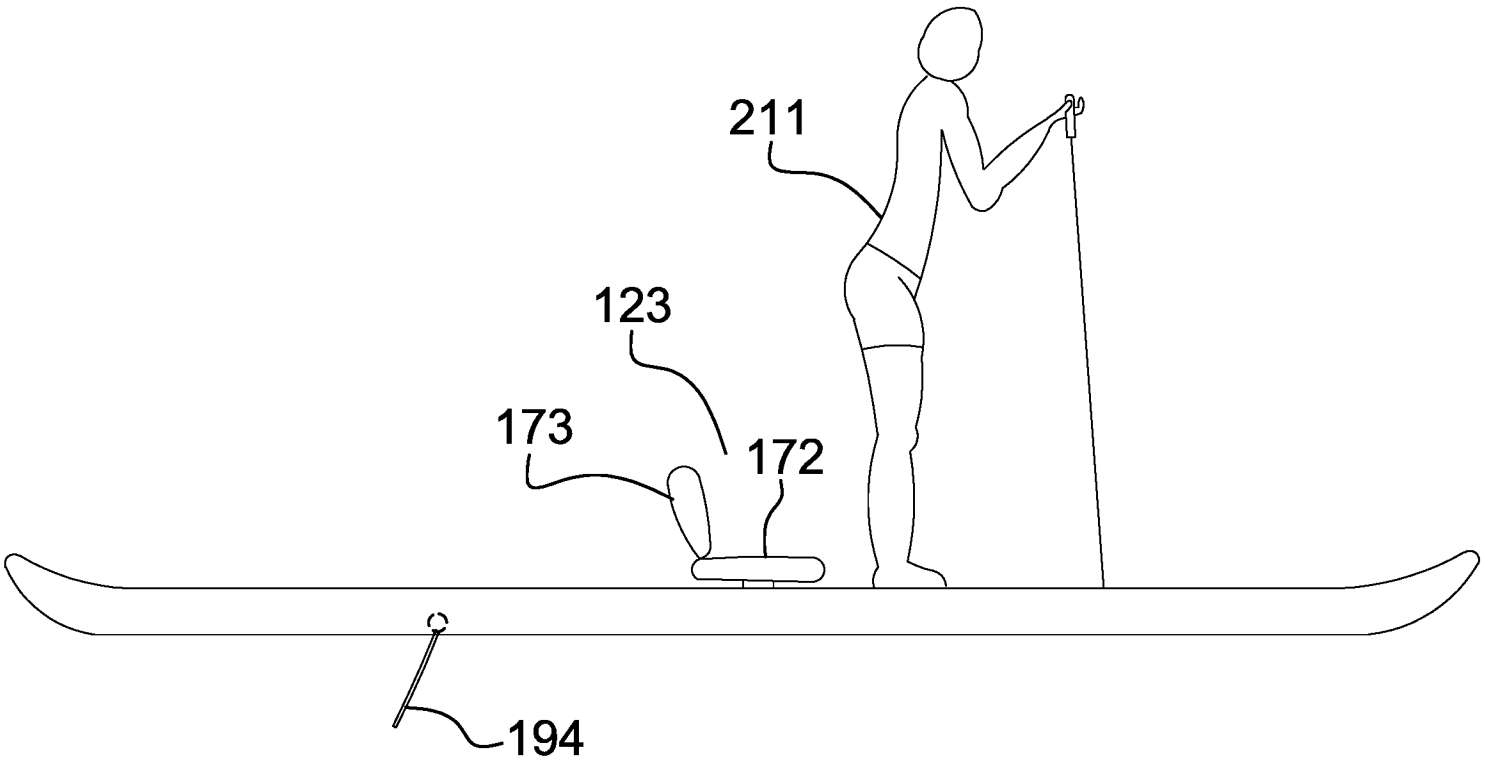
FIG. 7 is a side view of an embodiment of the disclosure.

Detailed reference will now be made to one or more potential embodiments of the disclosure, which are illustrated in FIGS. 1 through 7.

The mechanical oar system 100 (hereinafter invention) is a manually powered propulsion system for a vessel 102. The vessel 102 is a personal watercraft. The vessel is a flat bottom foam core floating platform. The invention 100 is configured for use with a person 211. The invention 100 is powered by the person 211. The invention 100 comprises a plurality of drive mechanisms 101 and a vessel 102. The plurality of drive mechanisms 101 are integrated into the vessel 102. Each of the plurality of drive mechanisms 101 is a simple machine or a compound machine. Each of the plurality of drive mechanisms 101 is manually powered. Each of the plurality of drive mechanisms 101 comprises a mechanism that propels an oar structure (referred to in this disclosure as a blade). The oar structure propels the vessel 102 in a desired direction. Each of the plurality of drive mechanisms 101 is oriented relative to the vessel 102 such that the direction of the propulsive forces can be adjusted by the person 211.

The vessel 102 is a watercraft used to transport the person 211. The vessel 102 is further defined with a bow 201, a port 202, a stern 203, a starboard 204, a forward 205 direction, and an aft 206 direction, a top side 207, and a bottom side 208. A primary direction of the vessel 102 is from the stern 203 towards the bow 201.

The bow 201 is defined in greater detail elsewhere in this disclosure. The port 202 is defined in greater detail elsewhere in this disclosure. The stern 203 is defined in greater detail elsewhere in this disclosure. The starboard 204 is defined in greater detail elsewhere in this disclosure. The forward 205 is defined in greater detail elsewhere in this disclosure. The aft 206 is defined in greater detail elsewhere in this disclosure. The top side 207 is the surface of the vessel 102 that is distal from the bottom side 208. The bottom side 208 is the surface of the vessel 102 that is in the water.

The vessel 102 further comprises one or more cable channels 121 and a seat 123.

Each of the one or more cable channels 121 is a hollow prism-shaped structure formed through the vessel 102. Each drive cable associated with the plurality of drive mechanisms 101 is routed through a cable channel selected from the one or more cable channels 121.

The seat 123 is a structure mounted on the top side 207 of the vessel 102. The seat 123 provides a structure for the person 211 to sit in. The seat 123 comprises a seat 123 track 171, a seat 123 bench 172, and a seat 123 backrest 173. The seat 123 track 171 is a dual rail structure mounted on the top side 207 of the vessel 102. Each rail of the seat 123 track 171 is parallel to the primary direction of the vessel 102. The seat 123 bench 172 is a horizontal surface. The seat 123 bench 172 attaches to the seat 123 track 171 such that the seat 123 bench 172 will move along the seat 123 track 171 in a direction parallel to the primary direction of the vessel 102. The seat 123 backrest 173 is a vertical supporting plate that attaches to the seat 123 bench 172 such that the person 211 can lean against the seat 123 backrest 173 when sitting in the seat 123.

Each of the plurality of drive mechanisms 101 is a machine selected from the group consisting of a simple machine and a compound machine. Each of the plurality of drive mechanisms 101 provides propulsion required to move the vessel 102. Each of the plurality of drive mechanisms 101 is manually powered by the person 211. Each of the plurality of drive mechanisms 101 attaches to the vessel 102. Each of the plurality of drive mechanisms 101 is oriented such that the direction of the propulsion can be adjusted by the person 211. By managing the direction of propulsion, the person 211 uses the plurality of drive mechanisms 101 to navigate the vessel 102. The plurality of drive mechanisms 101 comprises a plurality of forward drive mechanisms 111, a plurality of aft drive mechanisms 112, and a plurality of drive grips 113.

Each of the plurality of forward drive mechanisms 111 is a compound machine. Each of the plurality of forward drive mechanisms 111 is a cable driven device. Each of the plurality of forward drive mechanisms 111 provides the propulsion necessary to move the vessel 102 in the forward 205 direction. Each of the plurality of forward drive mechanisms 111 mounts off the centerline of the vessel 102 such that each of the plurality of forward drive mechanisms 111 simultaneously provides a lesser lateral thrust. Each of the plurality of forward drive mechanisms 111 comprises a forward blade 131, a forward blade track 132, and a forward drive cable 134.

The forward blade 131 is a flat structure. The forward blade 131 moves towards the stern 203 of the vessel 102. As the forward blade 131 moves through the water, a pressure differential is created between the aft 206 side of the forward blade 131 and the forward 205 side of the forward blade 131 that serves to propel the vessel 102 through the water.

The forward blade track 132 is a dual track structure. The forward blade track 132 guides the forward blade 131 as the forward blade 131 moves through the water towards the stern 203 of the vessel 102. The use of a track to guide a structure is well-known and documented in the mechanical arts.

The forward drive cable 134 is a wire cable. The forward drive cable 134 attaches to the forward blade 131 such that when the person 211 pulls on the forward drive cable 134 a force is applied to the forward blade 131 that moves the forward blade 131 towards the stern 203 of the vessel 102 thereby propelling the vessel 102 in the forward 205 direction. The forward drive cable 134 is routed through a cable channel selected from the one or more cable channels 121 for presentation to the person 211.

The plurality of forward drive mechanisms 111 comprises a port forward drive 191 and a starboard forward drive 192. The port forward drive 191 is identical to the starboard forward drive 192 with the exception that the starboard forward drive 192 is a mirror image of the port forward drive 191 when viewed from the top side 207.

The port forward drive 191 is a forward drive selected from the plurality of forward drive mechanisms 111. The port forward drive 191 provides a primary thrust in the forward 205 direction and a lesser thrust in the starboard 204 direction. The starboard forward drive 192 is a forward drive selected from the plurality of forward drive mechanisms 111. The starboard forward drive 192 provides a primary thrust in the forward 205 direction and a lesser thrust in the port 202 direction.

Each of the plurality of aft drive mechanisms 112 is a compound machine. Each of the plurality of aft drive mechanisms 112 is a cable driven device. Each of the plurality of aft drive mechanisms 112 provides the propulsion necessary to move the vessel 102 in the aft 206 direction. Each of the plurality of aft drive mechanisms 112 mounts off the centerline of the vessel 102 such that each of the plurality of aft drive mechanisms 112 simultaneously provides a lesser lateral thrust. Each of the plurality of aft drive mechanisms 112 comprises an aft blade 141, an aft blade track 142, and an aft drive cable 144.

The aft blade 141 is a flat structure. The aft blade 141 is identical to the forward blade 131. The aft blade 141 moves towards the bow 201 of the vessel 102. As the aft blade 141 moves through the water, a pressure differential is created between the forward 205 side of the aft blade 141 and the aft 206 of the aft blade 141 that serves to propel the vessel 102 through the water.

The aft blade track 142 is a dual track structure. The aft blade track 142 guides the aft blade 141 as the aft blade 141 moves through the water towards the bow 201 of the vessel 102. The use of a track to guide a structure is well-known and documented in the mechanical arts.

The aft drive cable 144 is a wire cable. The aft drive cable 144 attaches to the aft blade 141 such that when the person 211 pulls on the aft drive cable 144 a force is applied to the aft blade 141 that moves the aft blade 141 towards the bow 201 of the vessel 102 thereby propelling the vessel 102 in the aft 206 direction. The aft drive cable 144 is routed through a cable channel selected from the one or more cable channels 121 for presentation to the person 211.

The plurality of aft drive mechanisms 112 comprises a port aft drive 193 and a starboard aft drive 194. The port aft drive 193 is identical to the starboard aft drive 194 with the exception that the starboard aft drive 194 is a mirror image of the port aft drive 193 when viewed from the top side 207.

The port aft drive 193 is an aft drive selected from the plurality of aft drive mechanisms 112. The port aft drive 193 provides a primary thrust in the aft 206 direction and a lesser thrust in the starboard 204 direction. The starboard aft drive 194 is an aft drive selected from the plurality of aft drive mechanisms 112. The starboard aft drive 194 provides a primary thrust in the aft 206 direction and a lesser thrust in the port 202 direction.

As the forward blade 131 moves towards the stern 203 of the vessel 102, the passing water presses against the forward blade 131 such that a pressure differential is created between the aft 206 side and the forward 205 side of the forward blade 131. This pressure differential generates the forward 205 thrust produced by the forward blade 131.

As the aft blade 141 moves towards the bow 201 of the vessel 102, the passing water presses against the aft blade 141 such that a pressure differential is created between the aft 206 side and the forward 205 side of the aft blade 141. This pressure differential generates the aft 206 thrust produced by the aft blade 141.

Each of the plurality of drive grips 113 is a simple machine. Each of the plurality of drive grips 113 is an extension apparatus. The plurality of drive grips 113 is a cable management system. The plurality of drive grips 113 routes the drive cable associated with any drive mechanism selected from the group consisting of the plurality of forward drive mechanisms 111 and the plurality of aft drive mechanisms 112 towards the bow 201 of the vessel 102 such that the person 211 can manually operate the vessel 102 while seated in the forward 205 direction. By pulling on a drive grip selected from the plurality of drive grips 113, the person 211 will operate a drive mechanism associated with the selected drive grip. The plurality of drive grips 113 further comprises a handgrip 151. The handgrip 151 is a commercially available D-grip. The handgrip 151 provides a grip that allows the person 211 to grab a drive cable associated with the plurality of drive mechanisms 101.

The plurality of drive grips 113 further comprises a port forward drive grip 154, a starboard forward drive grip 155, a port aft drive grip 156, and a starboard aft drive grip 157. The port forward drive grip 154 is the drive grip selected from the plurality of drive grips 113 associated with the port forward drive 191 of the plurality of forward drive mechanisms 111. The starboard forward drive grip 155 is the drive grip selected from the plurality of drive grips 113 associated with the starboard forward drive 192 of the plurality of forward drive mechanisms 111. The port aft drive grip 156 is the drive grip selected from the plurality of drive grips 113 associated with the port aft drive 193 of the plurality of aft drive mechanisms 112. The starboard aft drive grip 157 is the drive grip selected from the plurality of drive grips 113 associated with the starboard aft drive 194 of the plurality of aft drive mechanisms 112.

The following definitions were used in this disclosure:

Aft: As used in this disclosure, aft is a term that relates a first object to a second object. When the second object is closer to the stern of a vehicle, the second object is said to be aft of the first object. The term is commonly used on vessels and vehicles.

Anterior: As used in this disclosure, anterior is a term that is used to refer to the front side or direction of a structure. When comparing two objects, the anterior object is the object that is closer to the front of the structure.

Bench: As used in this disclosure, a bench is a horizontal supporting surface formed by a chair.

Blade: As used in this disclosure, a blade is a term that is used to describe a wide and flat structure either individually or as a portion of a structure larger structure such as a propeller.

Bow: As used in this disclosure, the bow refers to the anterior side of a vehicle or vessel.

Compound Machine: See simple machine.

Cord: As used in this disclosure, a cord is a long, thin, flexible, and prism-shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Extension Apparatus: As used in this disclosure, an extension apparatus is a mechanical structure that is used to extend the span of the distance between any two objects or the reach of a first object towards a second object.

Forward: As used in this disclosure, forward is a term that relates a first object to a second object. When the first object is closer to the bow of a vehicle, the first object is said to be forward of the second object. The term is commonly used on vessels and vehicles.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Lateral: As used in this disclosure, the term lateral refers to the movement of an object that is perpendicular to the primary direction of an object and parallel to the horizontal plane (or perpendicular to the vertical plane). The lateral movement is always perpendicular to the primary direction. Lateral movement is often called sideways movement.

Medial: As used in this disclosure, the term medial is used to describe the relative location of two objects. The medial object is: 1) the object that is closer to a previously specified center axis when the direction of comparison is the radial direction; and 2) the object that is closer to a center point on a center axis when the direction of comparison is in the lateral direction. When an object is capable of movement, the center axis is often aligned with the primary direction of an object.

Orientation: As used in this disclosure, orientation refers to the positioning of a first object relative to: 1) a second object; or, 2) a fixed position, location, or direction.

Port: As used in this disclosure, port refers to the left side of a vehicle when a viewer is facing towards the primary direction of the vehicle.

Posterior: As used in this disclosure, posterior is a term that is used to refer to the side of an object that is distal or in the opposite direction of the anterior side. When comparing two items, the posterior item is the item that is distal from the front of the object.

Primary Direction: As used in this disclosure, the primary direction of an object refers to a vector that: 1) passes through the center of the object; and, 2) is parallel to the direction of travel when the anterior surface(s) of the object are leading the object into the direction of travel. This definition intends to align with what people would normally call the forward direction of an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Sheeting: As used in this disclosure, a sheeting is a material, such as a textile, a plastic, or a metal foil, in the form of a thin flexible layer or layers.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Simple Machine: As used in this disclosure, a simple machine refers to a device that consists of a mechanism selected from the group consisting of: 1) an inclined plane, 2) a lever; 3) a pivot, 4) a pulley, 5) a screw, 6) a spring, 7) a wedge, and 8) a wheel (including axles). A compound machine is a device that consists of a plurality of mechanisms selected from the group consisting of the simple machine.

Starboard: As used in this disclosure, starboard refers to the right side of a vehicle when a viewer is facing towards the primary direction of the vehicle.

Stern: As used in this disclosure, the stern refers to the posterior side of a vehicle or vessel.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vehicle: As used in this disclosure, a vehicle is a device used for transporting passengers, goods, or equipment. The term motorized vehicle refers to a vehicle can move under power provided by an electric motor or an internal combustion engine.

Vessel: As used in this disclosure, a vessel is a type of vehicle. A vessel transports passengers, goods, or equipment over water.

With respect to the above description, it is to be realized that the optimum dimensional relationship for the various components of the invention described above and in FIGS. 1 through 13 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A propulsion system comprising
a plurality of drive mechanisms and a vessel;
wherein each of the plurality of drive mechanisms attaches to the vessel;
wherein the vessel is a flat bottom floating platform;
wherein the vessel is further defined with a bow, a port side, a stern, a starboard side, a top side, and a bottom side;
wherein a primary direction of the vessel is from the stern towards the bow;
wherein each of the plurality of drive mechanisms is manually powered;
wherein each of the plurality of drive mechanisms provides a propulsion required to move the vessel;
wherein the vessel further comprises one or more cable channels and a seat;
wherein each of the one or more cable channels is a hollow prism-shaped structure formed through the vessel;
wherein the seat is a structure mounted on the top side of the vessel.

2. The propulsion system according to claim 1
wherein each of the plurality of drive mechanisms comprises a mechanism that propels a blade.

3. The propulsion system according to claim 2
wherein the plurality of drive mechanisms comprises a plurality of forward drive mechanisms, a plurality of aft drive mechanisms, and a plurality of drive grips;
wherein each of the plurality of forward drive mechanisms provides the propulsion necessary to move the vessel in the forward direction;
wherein each of the plurality of aft drive mechanisms provides the propulsion necessary to move the vessel in the aft direction;
wherein each of the plurality of drive grips is a linkage that manually drives a plurality of drive mechanisms selected from a group consisting of the plurality of forward drive mechanisms and the plurality of aft drive mechanisms.

4. The propulsion system according to claim 3
wherein each of the plurality of forward drive mechanisms comprises a forward blade, a forward blade track, and a forward drive cable;
wherein the forward blade track guides the forward blade as the forward blade moves through water;
wherein the forward drive cable attaches to the forward blade such that the forward drive cable transmits a force applied to the forward blade.

5. The propulsion system according to claim 4
wherein the forward blade is a flat structure;
wherein the forward blade moves towards the stern of the vessel;
wherein the forward blade propels the vessel through the water.

6. The propulsion system according to claim 5
wherein a forward return spring is a dual track structure;
wherein the forward drive cable is a wire cable;
wherein the forward drive cable attaches to the forward blade such that the forward drive cable transmits a force applied to the forward blade.

7. The propulsion system according to claim 6 wherein the forward drive cable is routed through a cable channel selected from the one or more cable channels.

8. The propulsion system according to claim 7
wherein each of the plurality of aft drive mechanisms comprises an aft blade, an aft blade track, and an aft drive cable;

wherein the aft blade track guides the aft blade as the aft blade moves through the water;

wherein the aft drive cable attaches to the aft blade such that the aft drive cable transmits a force applied to the aft blade.

9. The propulsion system according to claim 8 wherein the aft blade is a flat structure;

wherein the aft blade moves towards the stern of the vessel;

wherein the aft blade propels the vessel through the water.

10. The propulsion system according to claim 9 wherein the aft return spring is a dual track structure;

wherein the aft drive cable is a wire cable;

wherein the aft drive cable attaches to the aft blade such that the aft drive cable transmits a force applied to the aft blade.

11. The propulsion system according to claim 10 wherein the aft drive cable is routed through a cable channel selected from the one or more cable channels.

12. The propulsion system according to claim 11 wherein the plurality of forward drive mechanisms comprises a port forward drive and a starboard forward drive;

wherein the port forward drive is configured in a mirror image of the starboard forward drive;

wherein the port forward drive provides a primary thrust in a forward direction and a lesser thrust in a starboard direction;

wherein the starboard forward drive provides a primary thrust in the forward direction and a lesser thrust in a port direction.

13. The propulsion system according to claim 12 wherein the plurality of aft drive mechanisms comprises a port aft drive and a starboard aft drive;

wherein the port aft drive is configured in a mirror image of the starboard aft drive;

wherein the port aft drive provides a primary thrust in the aft direction and a lesser thrust in the starboard direction;

wherein the starboard aft drive provides a primary thrust in the aft direction and a lesser thrust in the port direction.

14. The propulsion system according to claim 13 wherein the plurality of drive grips is a cable management system;

wherein the plurality of drive grips routes the drive cable associated with a drive mechanism selected from the group consisting of the plurality of forward drive mechanisms and the plurality of aft drive mechanisms towards the bow of the vessel such that a person can manually operate the vessel while seated in the forward direction.

15. The propulsion system according to claim 14 wherein the plurality of drive grips further comprises a handgrip.

16. The propulsion system according to claim 15 wherein the plurality of drive grips further comprises a port forward drive grip, a starboard forward drive grip, a port aft drive grip, and a starboard aft drive grip;

wherein the port forward drive grip is selected from the plurality of drive grips associated with the port forward drive of the plurality of forward drive mechanisms;

wherein the starboard forward drive grip is selected from the plurality of drive grips associated with the starboard forward drive of the plurality of forward drive mechanisms;

wherein the port aft drive grip is selected from the plurality of drive grips associated with the port aft drive of the plurality of aft drive mechanisms;

wherein the starboard aft drive grip is selected from the plurality of drive grips associated with the starboard aft drive of the plurality of aft drive mechanisms.

17. The propulsion system according to claim 16 wherein the seat comprises a seat track, a seat bench, and a seat backrest;

wherein the seat bench is a horizontal surface;

wherein the seat bench attaches to the seat track such that the seat bench will move along the seat track in a direction parallel to the primary direction of the vessel;

wherein the seat backrest is a vertical supporting plate that attaches to the seat bench.

* * * * *